United States Patent [19]

Artman

[11] 4,186,460

[45] Feb. 5, 1980

[54] SLEEPER BOX HINGE

[76] Inventor: J. Clyde Artman, 4045 Gun Club Rd., Murrysville, Pa. 15668

[21] Appl. No.: 861,853

[22] Filed: Dec. 19, 1977

[51] Int. Cl.[2] ..... E05D 11/00; E05D 5/06

[52] U.S. Cl. ..... 16/137; 16/135; 49/383; 49/398

[58] Field of Search ..... 16/137, 135, 168, 161, 16/148; 49/380, 383, 398, 400, 397

[56] References Cited

U.S. PATENT DOCUMENTS

| | | | |
|---|---|---|---|
| 1,893,450 | 1/1933 | Shively | 49/383 |
| 1,950,874 | 3/1934 | Atwood | 49/398 |
| 2,557,716 | 6/1951 | Allee | 16/137 |
| 2,588,216 | 3/1952 | De Graaf | 16/161 |
| 2,752,014 | 6/1956 | Watson | 49/398 X |
| 3,566,539 | 3/1971 | Ridgley | 16/135 X |
| 3,690,037 | 9/1972 | Kempel | 49/380 |

FOREIGN PATENT DOCUMENTS

| | | | |
|---|---|---|---|
| 2517901 | 11/1976 | Fed. Rep. of Germany | 16/168 |
| 309972 | 7/1933 | Italy | 49/383 |
| 928795 | 6/1963 | United Kingdom | 16/168 |

*Primary Examiner*—James Kee Chi

*Attorney, Agent, or Firm*—Jon M. Lewis

[57] ABSTRACT

For doors of truck sleeper cabs, a sleeper box hinge is provided with flexible clip-on seals and an integral stop. The hinge swings away so that the door and a cabinet need not be forced against each other while the door is being opened.

3 Claims, 2 Drawing Figures

SLEEPER BOX HINGE

SUMMARY OF INVENTION

Field of Invention

This invention relates to a door hinge especially deisgned for use in a truck sleeper cab. It more particularly relates to a hinge with an integral stop and clip-on seal that swings away from the sleeper box cab when the door is opened.

DESCRIPTION OF THE PRIOR ART

There are multitudes of hinges known in the prior art. Amongst some of the hinges are U.S. Pat. No. 2,947,023 and U.S. Pat. No. 2,818,146 as well as most standard door hinges.

However, none of the prior art discloses a hinge that would be as useful as the present invention for truck sleeper cabs having an integral stop and rubber clip-on seals. None of the previous hinges would hold up as well under hard and constant over the road use while being subject to constant vibrations as the present invention. Further, the use of clip-on seals permits the replacement of the seal part of the door hinge so that it can be variably replaced when subject to wear or age, yet still give the hinge versatility of continued use. None of the prior art provides in combination a door hinge that swings the door away from a truck sleeper cab while having an integral stop and rubber clip-on seals.

SUMMARY OF INVENTION

My invention provides a sleeper box hinge that retains its water and air resistancy during its use. Sleeper boxes are box-shaped units attached to over the road trucks. They ordinarily sit behind the truck cab. The truck driver uses the sleeper box to store clothing, sleeping when tired and store miscellaneous other items.

A sleeper box is subject to the same hard use in winter as a truck. It is subject to weather, vibration and abuse.

The present invention provides a swinging door hinge that pivots about a self-lubricating pin. The self-lubricating pin facilitates motion. The door hinge swings away from the cab compartment directly next to it and is designed with an integral stop so that the door can open no more than the desired point.

Flexible clip-on seals are provided so that when the door is in a closed position, movement of air and/or water is restricted from flowing into the sleeper box.

The invention further lies in the novel structure and arrangement of the various elements of the device on which the invention is embodied, as well as in the cooperative association of the various elements thereof with one another.

DESCRIPTION OF THE PREFERRED EMBODIMENT

Figure 2:
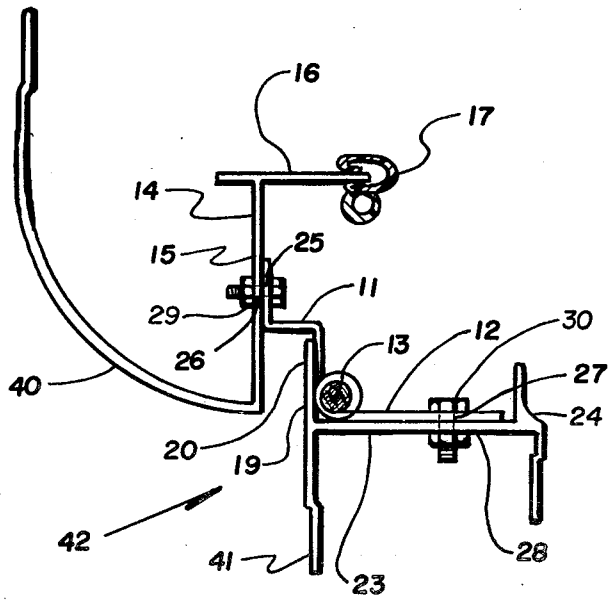
FIG. 2 is a partial cross-sectional view of a sleeper box hinge with a sleeper box door in the open position.
Figure 1:
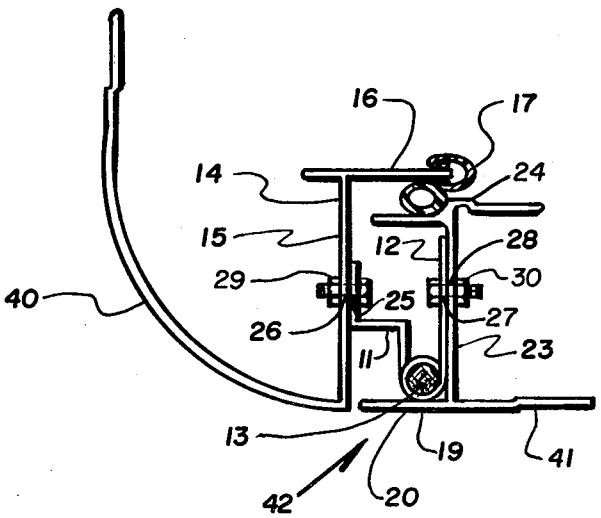
FIG. 1 is a partial cross-sectional view of a sleeper box hinge with a sleeper box door in the closed position.

Referring to the drawings, FIG. 1 discloses an embodiment of the present invention with the sleeper box door in the closed position while FIG. 2 discloses the same embodiment with the door in an open position. A sleeper box generally has a cabinet 40 and door 41. The present invention is doors connected to the cabinet by use of sleeper box hinge 42.

Frame member 11 is connected to a swinging member 12 and side wall member 14. A self-lubricating pin 13 is placed at the connection of the frame member 11 with swinging member 12. The self-lubricating pin 13 facilitates relatively frictioned free rotation about the pin. The side wall member 14 is connected to the sleeper box cabinet 40.

The side wall member 14 is dimensioned with a first side 15 relatively perpendicular to the cabinet 40 and the second side 16 substantially perpendicular to first side 15. A flexible clip-on seal 17 is connected to the end of the second side 16 furthest away from first side 15.

Means for closing sleeper box door 20 is attached with a swinging member 12 on the one hand and the sleeper box door 41 on the other.

Said means 23 includes an integral stop 20 placed on door 41. Said integral stop 20 includes an overhang 19. When the door is open the overhand 19 hits the frame member 11 so that the door 41 is forced against frame member 11. When forced against frame member 11, the door 41 cannot open further. When the door 41 is closed, the overhand 19 does not touch or hit side wall member 14 for this is an important part of the invention so that the door 41 swings away from the cabinet 40. This swing away provision is important to the present invention because it tends to preserve the door 41, cabinet 40 and sleeper box hinge 42 from being prematurely wearing or losing effectiveness during over the road truck use or abuse.

The means 23 further includes a seal component 24 dimentioned on the side of door 41 so that when the door is closed, the seal component is placed against the flexible clip-on seal 17 to inhibit the flow of air and water when the door is closed.

The preferred embodiment frame member 11 is dimensioned with first aperture 25. Side wall member 14 is dimensioned with second aperture 26, that is placed directly opposite first aperture 25. First fastening member 29 hold the frame member 11 and side wall member 14 together.

Swinging member 12 is dimensioned with first orifice 27 while means 23 is dimensioned with second orifice 28 situated directly opposite first orifice 27. Second fastening member 30 holds the swinging member 12 and means 23 together.

In operation when door 41 is opened it swings back so that overhand 19 hits the frame member 11 to stop the door 41. When the door 41 is closed, overhand 19 does not touch side wall member 14. The seal component 24 forms a seal with flexible clip-on seal 17 to prevent air and water from passing through into the sleeper box.

As it may readily appear to those skilled in the art, various changes may be made in relative locations and arrangements of the several parts without departing from the sphere and scope of this invention. It is not meant to limit the invention except by the following claims:

I claim:

1. A sleeper box hinge comprising:

a. a frame member;

b. a swinging member attached to the frame member;

c. a self-lubricating pin fit at the location of the frame member and swinging member, to facilitate the free rotation of the swinging member about the frame member;

d. a side wall member dimensioned on the side of a sleeper box and attached to the frame member, said side wall member having a first side perpendicular to its second side;

e. a flexible clip-on seal attached to the first side and located furtherest away from the second side; and f. means for closing a sleeper box door so that water and air are prevented from passing through a rubber seal, as well as stopping the door when opened at the desired position, and attached to the swinging member.

2. The device of claim 1 wherein said means further comprises:

a. an integral stop dimensioned on a sleeper box door, said integral stop having an overhang that does not touch the side wall member when closed while it hits the frame member when the door is open to prevent the door from opening further; and b. a seal component dimensioned on said sleeper box door so that when the door is closed, the seal component is pressed against the flexible clip-on seal to prevent passage of air and water.

3. a. The frame member is dimensioned with a first aperture and swinging member is dimensioned with a first orifice;

b. The side wall member is dimensioned with a second aperture that is opposite the first aperture;

c. the means is dimensioned with a second orifice which fits opposite the first orifice;

d. a first fastening means that passes through the first aperture and second aperture to hold frame member and side wall member together; and e. a second fastening member that fits through the first orifice and second orifice and holds the swinging member and means together.

* * * * *